US012359601B2

(12) United States Patent
Yamada et al.

(10) Patent No.: US 12,359,601 B2
(45) Date of Patent: Jul. 15, 2025

(54) INSTALLATION STRUCTURE FOR AIR CONTROL DEVICE

(71) Applicant: SUZUKI MOTOR CORPORATION, Hamamatsu (JP)

(72) Inventors: Shinichi Yamada, Hamamatsu (JP); Yuki Ryu, Hamamatsu (JP)

(73) Assignee: SUZUKI MOTOR CORPORATION, Hamamatsu (JP)

( * ) Notice: Subject to any disclaimer, the term of this patent is extended or adjusted under 35 U.S.C. 154(b) by 0 days.

(21) Appl. No.: 18/679,745

(22) Filed: May 31, 2024

(65) Prior Publication Data

US 2025/0027433 A1 Jan. 23, 2025

(30) Foreign Application Priority Data

Jul. 20, 2023 (JP) ..... 2023-118384

(51) Int. Cl.
*F01N 3/30* (2006.01)

(52) U.S. Cl.
CPC ..... *F01N 3/30* (2013.01); *F01N 2270/00* (2013.01); *F01N 2340/04* (2013.01); *F01N 2590/04* (2013.01)

(58) Field of Classification Search
CPC .... F01N 3/30; F01N 2270/00; F01N 2340/04; F01N 2590/04
See application file for complete search history.

(56) References Cited

U.S. PATENT DOCUMENTS 4,430,857 A 2/1984 Ikenoya et al. ..... 60/274
5,657,628 A * 8/1997 Takeuchi ..... F01N 3/34 180/219
2004/0216726 A1 11/2004 Hori et al. ..... 123/699
2005/0193725 A1 9/2005 Kaneshiro ..... 60/305
2005/0279330 A1* 12/2005 Okazaki ..... B62J 35/00 137/565.17
2008/0135317 A1* 6/2008 Kajiwara ..... B62J 17/02 180/219
2015/0251720 A1* 9/2015 Nishimura ..... F02M 35/048 123/26
2022/0112829 A1* 4/2022 Hatanaka ..... F01N 3/34

FOREIGN PATENT DOCUMENTS

DE 10 2019 118 201 A1 1/2020
EP 2 159 393 B1 8/2008
EP 2 915 971 B1 3/2015
JP 2018-119482 A 8/2018

OTHER PUBLICATIONS

Machine translation of DE102019118201 A1, accessed Feb. 13, 2025 (Year: 2025).*
Extended European Search Report dated Oct. 29, 2024, issued by the European Patent Office in corresponding application EP 24177686.3.

* cited by examiner

*Primary Examiner* — Jonathan R Matthias
(74) *Attorney, Agent, or Firm* — Stein IP, LLC

(57) ABSTRACT

An installation structure for an air control device, the air control device being configured to control supply of secondary air from an air cleaner to an exhaust passage of an engine. A cylinder head is located above the engine. A cylinder head cover is installed on the cylinder head. A fuel tank is installed above the cylinder head cover. The air control device is installed on a lateral side of the cylinder head cover below the fuel tank.

6 Claims, 7 Drawing Sheets

INSTALLATION STRUCTURE FOR AIR CONTROL DEVICE

CROSS-REFERENCE TO RELATED APPLICATION(S)

This application is based on and claims priority under 35 USC 119 from Japanese Patent Application No. 2023-118384 filed on Jul. 20, 2023, the entire content of which is incorporated herein by reference.

TECHNICAL FIELD

The present invention relates to an installation structure for an air control device.

BACKGROUND ART

A secondary air supply device for promoting combustion of unburned gas in exhaust gas for the purpose of reducing air pollutants is mounted on an engine. In the secondary air supply device, a secondary air passage extends from an air cleaner to an exhaust port of the engine, and an air control device is attached in the middle of the passage. Secondary air flowing toward the exhaust port is controlled by the air control device, secondary air is supplied to the exhaust port, and unburned gas in the exhaust gas is combusted again. As a straddle-type vehicle including this type of secondary air supply device, a vehicle in which an air control device is installed above an engine has been proposed (for example, see Patent Literature 1).

CITATION LIST

Patent Literature

Patent Literature 1: JP2018-119482A

In the model described in Patent Literature 1, a fuel tank is installed above the engine in addition to the air control device, and a tank bottom surface of the fuel tank may be recessed so as not to interfere with the air control device. In this case, a tank capacity decreases by an amount that the tank bottom surface of the fuel tank is recessed. A configuration in which the fuel tank is moved upward so as to avoid the air control device, or the tank is expanded by an amount that the tank bottom surface is recessed is also conceivable, but there is a problem that a center of gravity of the vehicle or a height of a seat becomes high, and thus marketability decreases.

SUMMARY

The present invention has been made in view of the above circumstances, and an object of the present invention is to provide an installation structure for an air control device capable of installing the air control device below a fuel tank without reducing marketability.

An installation structure for an air control device according to an aspect of the present invention is an installation structure for an air control device, the air control device being configured to control supply of secondary air from an air cleaner to an exhaust passage of an engine, in which a cylinder head is located above the engine, a cylinder head cover is installed on the cylinder head, a fuel tank is installed above the cylinder head cover, and the air control device is installed on a lateral side of the cylinder head cover below the fuel tank.

According to the installation structure for an air control device of the aspect of the present invention, the air control device is installed in a dead space on the lateral side of the cylinder head cover below the fuel tank. The air control device is installed by effectively utilizing the dead space, so that it is not necessary to change a tank shape or tank layout of the fuel tank in order to secure an installation space for an air control device. It is possible to install the air control device below the fuel tank without changing a design such as a decrease in a tank capacity of the fuel tank or an upward movement of the fuel tank, which reduces marketability.

BRIEF DESCRIPTION OF DRAWING(S)

DESCRIPTION OF EMBODIMENTS

An air control device according to an aspect of the present invention controls supply of secondary air from an air cleaner to an exhaust passage of an engine. In an installation structure for an air control device, a cylinder head is located above the engine, a cylinder head cover is installed on the cylinder head, and a fuel tank is installed above the cylinder head cover. The air control device is installed in a dead space on a lateral side of the cylinder head cover below the fuel tank. The air control device is installed by effectively utilizing the dead space, so that it is not necessary to change a tank shape or tank layout of the fuel tank in order to secure an installation space for an air control device. It is possible to install the air control device below the fuel tank without changing a design such as a decrease in a tank capacity of the fuel tank or an upward movement of the fuel tank, which reduces marketability.

Embodiment

Figure 1:
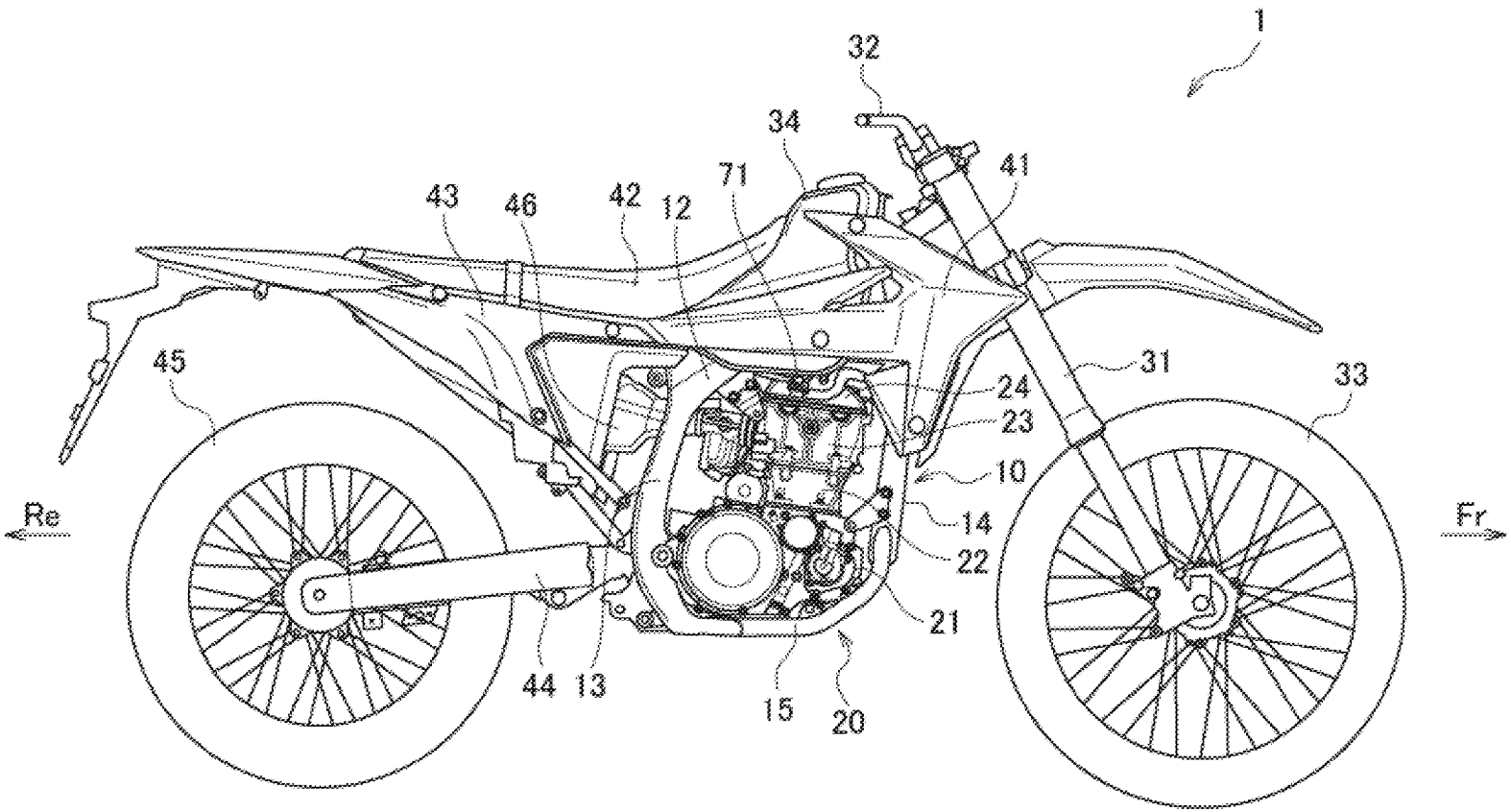
FIG. 1 is a right side view of a straddle-type vehicle according to the present embodiment.

Hereinafter, a straddle-type vehicle according to the present embodiment will be described with reference to the accompanying drawings. FIG. 1 is a right side view of the straddle-type vehicle according to the present embodiment. In the following drawings, an arrow Fr indicates a vehicle front side, an arrow Re indicates a vehicle rear side, an arrow L indicates a vehicle left side, and an arrow R indicates a vehicle right side.

As shown in FIG. 1, the straddle-type vehicle 1 is configured by mounting various components such as an engine 20 and an electrical system on a vehicle body frame 10. A pair of main frames 12 extend obliquely rearward and downward from a head pipe 11 (see FIG. 4) of the vehicle body frame 10, and rear portions of the pair of main frames 12 form a pair of body frames 13 bent downward. A down frame 14 extends downward from the head pipe 11, and a pair of under frames 15 bent rearward are connected to a lower portion of the down frame 14. Rear end portions of the pair of under frames 15 are connected to lower portions of the pair of body frames 13, and the vehicle body frame 10 is formed in a cradle shape.

A front fork 31 is steerably supported by the head pipe 11 via a steering shaft (not shown). A handlebar 32 is provided on an upper portion of the front fork 31, and a front wheel 33 is rotatably supported on a lower portion of the front fork 31. A fuel tank 34 is placed over upper portions of the pair of main frames 12, and the main frames 12 and the fuel tank 34 are covered by front side covers 41 from lateral sides. A seat 42 is installed behind the fuel tank 34, and a seat frame supporting the seat 42 from below is covered from the lateral side by a rear side cover 43.

A swing arm 44 is swingably supported by the body frames 13. The swing arm 44 extends rearward from the body frame 13, and a rear wheel 45 is rotatably supported at a rear end of the swing arm 44. The engine 20 is a four-stroke single-cylinder engine, and is suspended inside the vehicle body frame 10 via a plurality of suspension brackets. A cylinder assembly in which a cylinder 22, a cylinder head 23, and a cylinder head cover 24 are stacked is attached to an upper portion of a crankcase 21 of the engine 20. An intake device such as an air cleaner 46 is installed behind the cylinder head 23.

A secondary air supply device that promotes combustion of unburned gas in exhaust gas is mounted on the straddle-type vehicle 1 according to the present embodiment. In the secondary air supply device, a passage for secondary air from the air cleaner 46 to an exhaust passage is formed, and an air cut valve (air control device) 71 for controlling supply of secondary air is installed in the middle of the passage. In this case, when the air cut valve 71 is disposed above the engine 20, the air cut valve 71 may interfere with the fuel tank 34. In the present embodiment, the air cut valve 71 is disposed in a dead space on a lateral side of the cylinder head cover 24 so that the air cut valve 71 does not interfere with the fuel tank 34.

Figure 2:
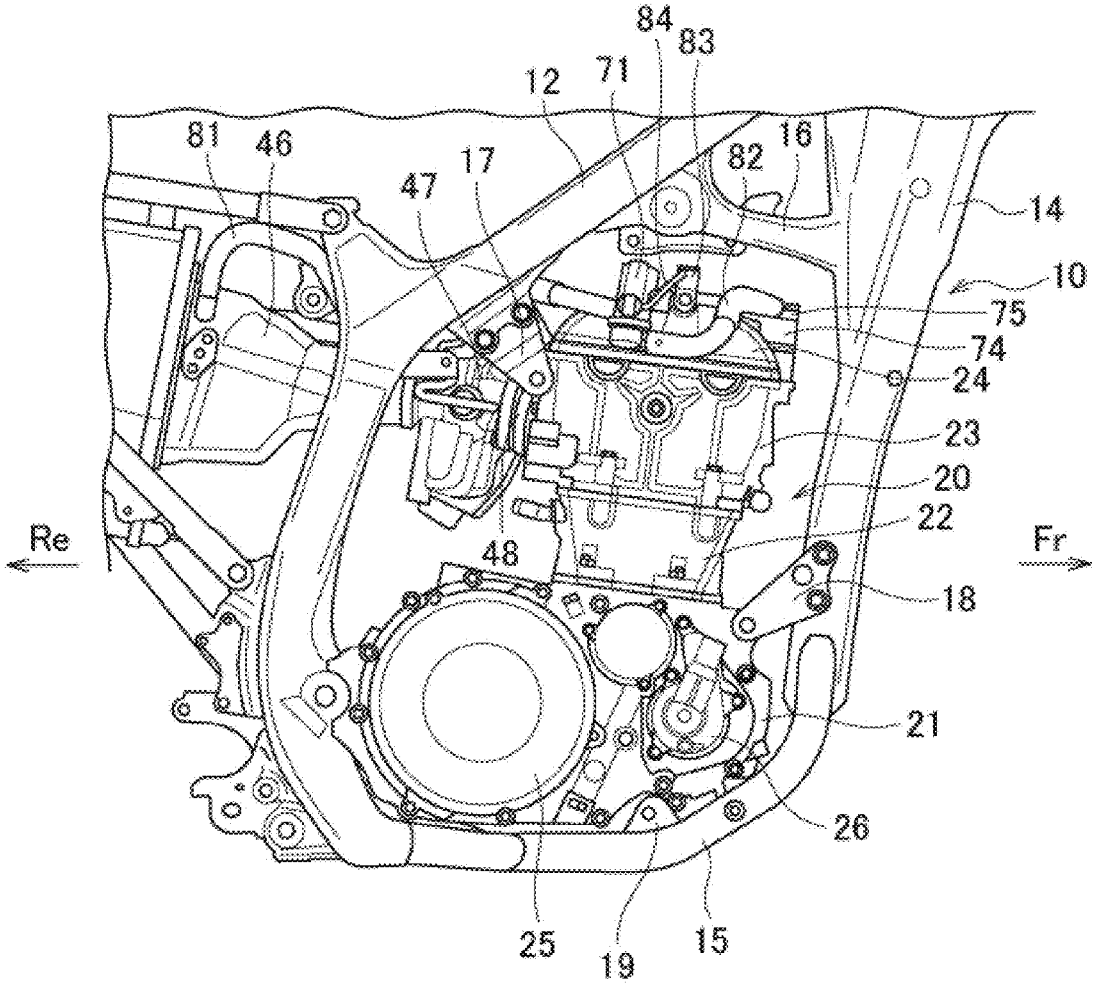
FIG. 2 is a right side view of a periphery of an engine according to the present embodiment.
Figure 3:
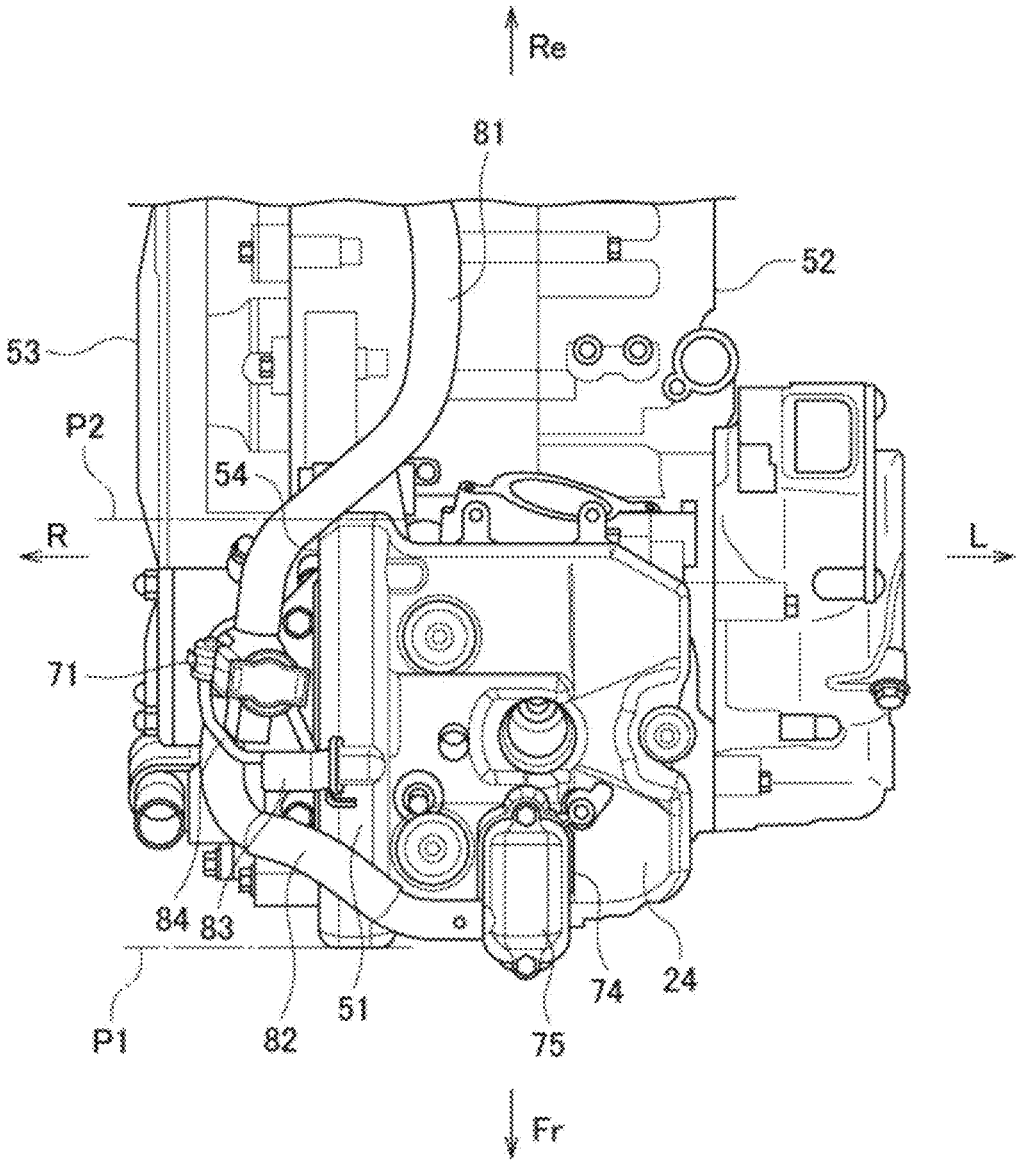
FIG. 3 is a top view of the periphery of the engine according to the present embodiment.
Figure 4:
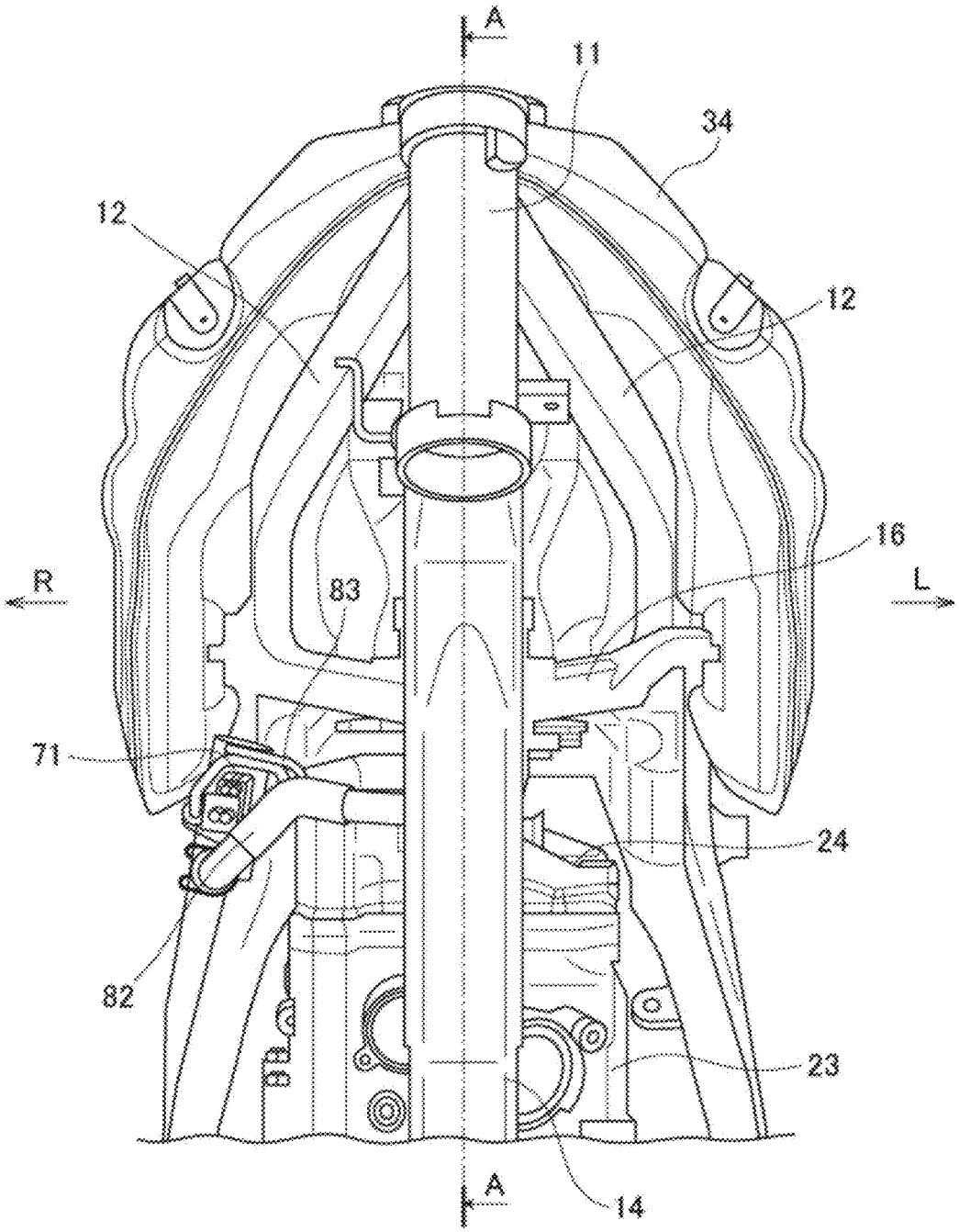
FIG. 4 is a front view of a periphery of a fuel tank according to the present embodiment.
Figure 5:
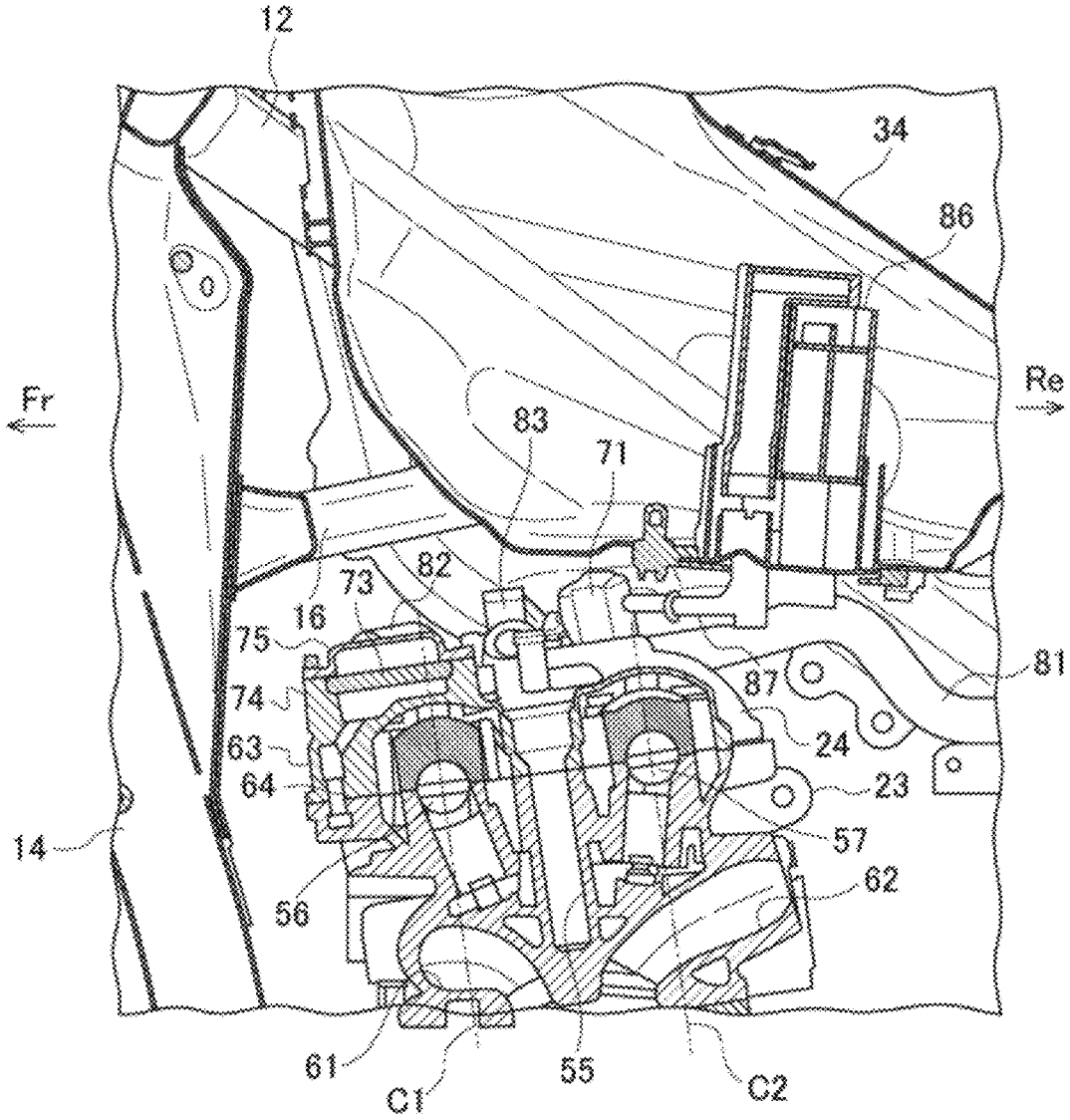
FIG. 5 is a cross-sectional view of the periphery of the fuel tank in FIG. 4 taken along a line A-A.

An installation structure for an air cut valve will be described with reference to FIGS. 2 to 5. FIG. 2 is a right side view of a periphery of the engine according to the present embodiment. FIG. 3 is a top view of the periphery of the engine according to the present embodiment. FIG. 4 is a front view of a periphery of the fuel tank according to the present embodiment. FIG. 5 is a cross-sectional view of the periphery of the fuel tank in FIG. 4 taken along a line A-A.

As shown in FIG. 2, the pair of main frames 12 and the down frame 14 are connected to each other via bridge tubes 16 for reinforcement at an upper portion of the vehicle body frame 10. Below the bridge tubes 16, the cylinder head 23 at an upper portion of the engine 20 and the crankcase 21 at a lower portion of the engine 20 are suspended from the vehicle body frame 10 by suspension brackets 17 to 19. The cylinder 22 is installed on the crankcase 21, and the cylinder head 23 is installed on the cylinder 22. The cylinder head cover 24 is installed on the cylinder head 23, and a double overhead cam shaft (DOHC) type valve train is accommodated inside the cylinder head 23 and the cylinder head cover 24.

A clutch cover 25 that covers a clutch (not shown) from the lateral side is attached to a right side surface of the crankcase 21. A water pump 26 for feeding cooling water to the engine 20 is attached in front of the clutch cover 25. The air cleaner 46 is disposed behind the engine 20. The air cleaner 46 is connected to a rear side (intake side) of the cylinder head 23 via a throttle body 47 and an intake pipe 48. After air is sent from the air cleaner 46 to the throttle body 47 and an intake amount is adjusted by the throttle body 47, air is supplied from the throttle body 47 to an intake port 62 (see FIG. 5) of the cylinder head 23 through the intake pipe 48.

As shown in FIGS. 2 and 3, an electromagnetic air cut valve 71 is installed on the right side of the cylinder head cover 24 as an air control device for secondary air. An accommodating portion 74 for a reed valve 73 (see FIG. 5) is provided on a front side (exhaust side) of the cylinder head cover 24, and the accommodating portion 74 is closed from above by a reed valve cover 75. A first hose 81 extends from the air cleaner 46 to the air cut valve 71, and a second hose 82 extends from the air cut valve 71 to the reed valve cover 75. An internal flow path extends from the inside of the reed valve cover 75 to the exhaust port 61 (see FIG. 5) of the cylinder head 23.

Secondary air is sent from the air cleaner 46 to the air cut valve 71 through the first hose 81, a timing of feeding the secondary air is controlled by the air cut valve 71, and the secondary air is sent from the air cut valve 71 into the reed valve cover 75 through the second hose 82. Secondary air is supplied from the inside of the reed valve cover 75 to the exhaust port 61, and unburned gas in the exhaust gas is combusted again to reduce air pollutants. Since the reed valve 73 is disposed in the reed valve cover 75, the reed valve 73 prevents the exhaust gas from flowing back from the exhaust port 61 to the air cleaner 46 side.

The air cut valve 71 is supported by the cylinder head cover 24 via a bracket 83 in a floating state. The bracket 83 is formed into an inverted L shape with a vertical plate portion and a horizontal plate portion, and the vertical plate portion of the bracket 83 is fixed to an upper wall 51 of a cam chain chamber of the cylinder head cover 24. An inverted U-shaped linear member 84 with both ends facing downward is provided on the horizontal plate portion of the bracket 83, and the air cut valve 71 is attached to both ends of the linear member 84. As compared with a configuration in which the air cut valve 71 is supported by the vehicle body frame 10, the air cut valve 71 can be installed close to the cylinder head cover 24.

In this case, in a top view, the air cut valve 71 is positioned between both left and right side surfaces 52 and 53 of the crankcase 21, and more specifically, between a right side surface 53 of the crankcase 21 and a right side surface 54 of the cylinder head cover 24. In a top view, the air cut valve 71 is located at a rear side of a front end position PI of the cylinder head cover 24 and a front side of a rear end position P2 of the cylinder head cover 24. The air cut valve 71 is brought close to the cylinder head cover 24 in a left-right direction without interfering with the fuel tank 34 (see FIG. 4). Accordingly, the second hose 82 extending from the air cut valve 71 to the reed valve cover 75 is shortened.

As shown in FIGS. 4 and 5, the pair of left and right main frames 12 extend from the head pipe 11 toward the vehicle rear side, and the fuel tank 34 is installed on the pair of left and right main frames 12 above the cylinder head cover 24. A plug hole 55 for an ignition plug (not shown) is formed in a center of the cylinder head cover 24 and the cylinder head 23. Inside the cylinder head cover 24 and the cylinder head 23, an exhaust camshaft 56 for an exhaust valve (not shown) is installed in front of the plug hole 55, and an intake camshaft 57 for an intake valve (not shown) is installed more rearward than the plug hole 55.

The air cut valve 71 is installed on the lateral side of the cylinder head cover 24 below the fuel tank 34 via the bracket 83. In a side view, the bracket 83 is positioned between axes C1 and C2 that pass through the centers of the exhaust camshaft 56 and the intake camshaft 57 and are parallel to a cylinder axis. The reed valve 73 is installed in front of the plug hole 55 in a side view, and the reed valve 73 is positioned on the axis C1 passing through the exhaust camshaft 56. The air cut valve 71 is installed more rearward than the plug hole 55 in a side view, and the air cut valve 71 is positioned on the axis C2 passing through the intake camshaft 57.

The exhaust port 61 is formed in the cylinder head 23 below the exhaust camshaft 56, and the intake port 62 is formed in the cylinder head 23 below the intake camshaft 57. Above the exhaust camshaft 56, an installation space of the reed valve 73 is formed inside the accommodating portion 74 and the reed valve cover 75. Front walls of the cylinder head 23 and the cylinder head cover 24 partially protrude in front of the exhaust camshaft 56. A secondary air supply path 64 extending from a bottom surface of the accommodating portion 74 to the exhaust port 61 is formed inside a protruding portion 63 of the cylinder head 23 and the cylinder head cover 24.

Although the fuel tank 34 is installed above the cylinder head cover 24, interference between the fuel tank 34 and the air cut valve 71 is prevented by installing the air cut valve 71 on the lateral side of the cylinder head cover 24. The air cut valve 71 is installed at a vehicle rear side of the reed valve 73, and the second hose 82 is disposed in the air cut valve 71 from the reed valve cover 75 on the cylinder head cover 24 to the lateral side of the cylinder head cover 24. Since the second hose 82 passes on the lateral side of the cylinder head cover 24, the second hose 82 can be shortened by an arrangement route avoiding the fuel tank 34.

Figure 6:
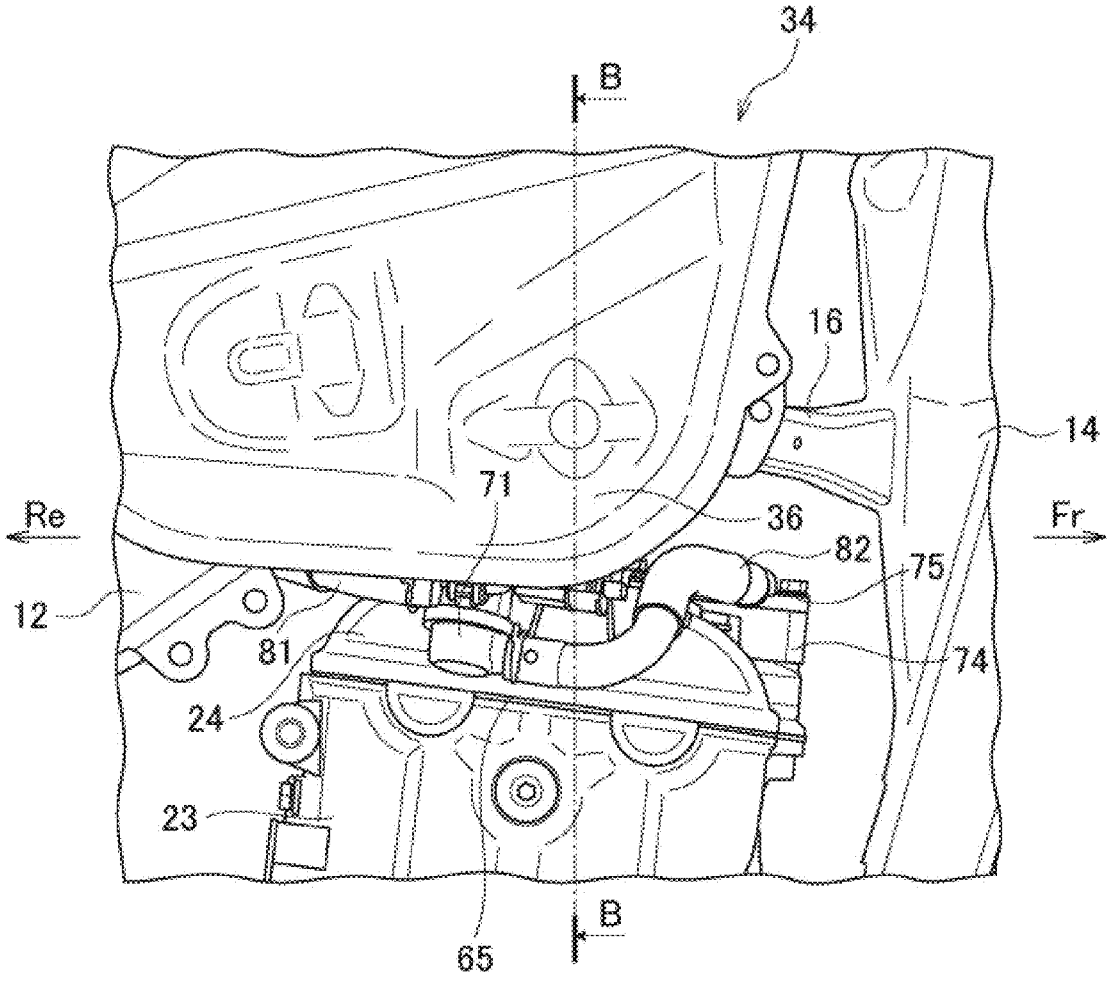
FIG. 6 is a right side view of a periphery of an upper portion of the engine according to the present embodiment.
Figure 7:
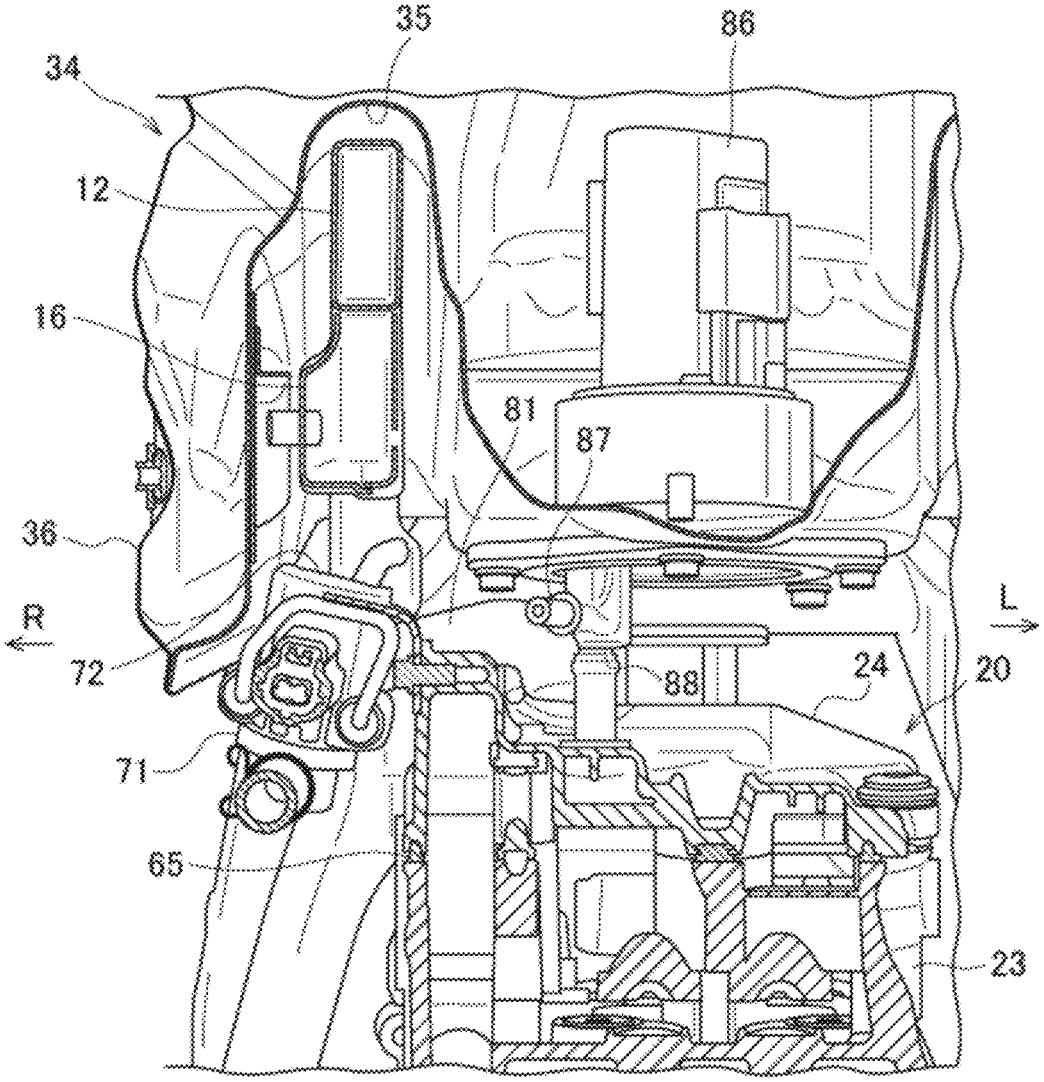
FIG. 7 is a cross-sectional view of the periphery of the upper portion of the engine in FIG. 6 taken along a line B-B.

Layout of the air cut valve will be described with reference to FIGS. 6 and 7. FIG. 6 is a right side view of a periphery of the upper portion of the engine according to the present embodiment. FIG. 7 is a cross-sectional view of the periphery of the upper portion of the engine in FIG. 6 taken along a line B-B.

As shown in FIGS. 6 and 7, the fuel tank 34 extends across the pair of left and right main frames 12, and the main frames 12 and the bridge tubes 16 are covered from the lateral sides by the fuel tank 34. Both left and right sides of the bottom surface of the fuel tank 34 are recessed upward, and the main frames 12 and the bridge tubes 16 enter recesses 35 of the fuel tank 34. Outer side portions 36 that cover the main frames 12 from the lateral sides are formed further outward in the left-right direction than the recesses 35 of the fuel tank 34. The outer side portion 36 of the fuel tank 34 extends below the bridge tube 16 and a center of the bottom surface of the fuel tank 34, and a lower end of the outer side portion 36 is positioned at substantially the same height as an upper surface of the cylinder head cover 24.

Below the main frame 12 and the bridge tube 16, the cylinder head cover 24 and the outer side portion 36 of the fuel tank 34 are separated. The air cut valve 71 is installed by effectively utilizing a space between the cylinder head cover 24 and the outer side portion 36 of the fuel tank 34. In a side view, a part of the air cut valve 71 overlaps the outer side portion 36 of the fuel tank 34, so that the air cut valve 71 becomes inconspicuous, and appearance is improved. In addition, an operation sound of the air cut valve 71 is blocked by the outer side portion 36 of the fuel tank 34, and becomes difficult to reach a driver. When the vehicle falls down, the air cut valve 71 is protected from an impact by the outer side portion 36 of the fuel tank 34.

Since the air cut valve 71 is disposed in the space below the main frame 12, the fuel the space below the main frame 12, so that it is not necessary to increase the size of the fuel tank 34 in the left-right direction. The air cut valve 71 is located above a mating surface 65 of the cylinder head 23 and the cylinder head cover 24. Since the air cut valve 71 is separated upward from the cylinder head 23 that is a heat source, heat damage to the air cut valve 71 that is an electronic device is prevented, and durability of the air cut valve 71 is improved.

In a cross-sectional view, the center of the bottom surface of the fuel tank 34 is at substantially the same height as a lower surface of the bridge tube 16, and a fuel pump 86 is installed at the center of the bottom surface of the fuel tank 34. The fuel pump 86 is located more rearward than the air cut valve 71 (see FIG. 5), and a nipple (part) 87 of the fuel pump 86 protrudes downward from the bottom surface of the fuel tank 34 above the cylinder head cover 24. An upper end 72 of the air cut valve 71 on the lateral side of the cylinder head cover 24 is positioned more upward than a lower end 88 of the nipple 87 above the cylinder head cover 24. A position of the fuel pump 86 is brought close to the cylinder head cover 24, and a tank capacity of the fuel tank 34 is sufficiently secured.

As described above, according to the installation structure for the air cut valve 71 according to the present embodiment, the air cut valve 71 is installed in the dead space on the lateral side of the cylinder head cover 24 below the fuel tank 34. Since the air cut valve 71 is installed by effectively utilizing the dead space, it is not necessary to change a tank shape or tank layout of the fuel tank 34 in order to secure an installation space of the air cut valve 71. It is possible to install the air cut valve 71 below the fuel tank 34 without changing a design such as a decrease in the tank capacity of the fuel tank 34 or an upward movement of the fuel tank 34, which reduces marketability.

In the present embodiment, the air cut valve is installed on the right side of the cylinder head cover below the main frame on the right side, but the air cut valve may be installed on the left side of the cylinder head cover below the main frame on the left side.

In the present embodiment, the air cut valve is installed between the outer side portion of the fuel tank and the cylinder head cover, but the air cut valve may be installed on the lateral side of the cylinder head cover below the fuel tank.

In the present embodiment, the vehicle body frame in which the pair of main frames extends from the head pipe to the vehicle rear side is exemplified, but a structure of the vehicle body frame is not particularly limited.

In the present embodiment, the air cut valve is supported by the cylinder head cover via the bracket, but the air cut valve may be supported by the fuel tank or the vehicle body frame via the bracket.

The installation structure for an air cut valve according to the present embodiment is not limited to the off load type straddle-type vehicle described above, and may be adopted in other types of straddle-type vehicles. The straddle-type vehicle is not limited to a general vehicle in which a driver rides while straddling a seat, and includes a scooter-type vehicle in which the driver rides without straddling a seat.

As described above, according to a first aspect, there is provided an installation structure for an air control device (air cut valve 71) that controls supply of secondary air from an air cleaner (46) to an exhaust passage (exhaust port 61) of an engine (20), in which a cylinder head (23) is located above the engine, a cylinder head cover (24) is installed on the cylinder head, a fuel tank (34) is installed above the cylinder head cover, and the air control device is installed on a lateral side of the cylinder head cover below the fuel tank. According to this configuration, the air control device is installed in a dead space on the lateral side of the cylinder head cover below the fuel tank. The air control device is installed by effectively utilizing the dead space, so that it is not necessary to change a tank shape or tank layout of the fuel tank in order to secure an installation space for an air control device. It is possible to install the air control device below the fuel tank without changing a design such as a decrease in a tank capacity of the fuel tank or an upward movement of the fuel tank, which reduces marketability.

According to a second aspect, in the first aspect, a pair of left and right main frames (12) extends from a head pipe (11) toward a vehicle rear side, the fuel tank straddles the pair of left and right main frames, the fuel tank is formed with outer side portions (36) covering the pair of left and right main frames from lateral sides, the air control device is installed between the cylinder head cover and the outer side portion of the fuel tank, and a part of the air control device overlaps with the outer side portion of the fuel tank in a side view. According to this configuration, even when the air control device is installed on the lateral side of the cylinder head cover, a part of the air control device is covered with the outer side portion of the fuel tank from the lateral side, so that the air control device becomes less conspicuous, and appearance is improved. An operation noise of the air control device is blocked by the outer side portion of the fuel tank, and becomes difficult to reach a driver. When the vehicle falls down, the air control device is protected from an impact by the outer side portion of the fuel tank.

According to a third aspect, in the first aspect and the second aspect, a part (nipple 87) of a fuel pump protrudes from a bottom surface of the fuel tank above the cylinder head cover, and an upper end of the air control device on the lateral side of the cylinder head cover is positioned more upward than a lower end of the fuel pump above the cylinder head cover. According to this configuration, a position of the fuel pump is brought close to the cylinder head cover, the bottom surface of the fuel tank is lowered, and the tank capacity can be sufficiently secured.

According to a fourth aspect, in any one of the first to third aspects, the pair of left and right main frames extend from the head pipe toward the vehicle rear side, and the air control device is installed below one of the pair of left and right main frames. According to this configuration, the fuel tank does not interfere with the air control device below the main frame. The air control device is accommodated in a space below the main frame, so that it is not necessary to increase a size of the fuel tank in a left-right direction.

According to a fifth aspect, in any one of the first to fourth aspects, the air control device is located above a mating surface (65) of the cylinder head and the cylinder head cover. According to this configuration, the air control device is separated from the cylinder head that is the heat source, so that heat damage to the air control device that is an electronic device is prevented, and durability of the air control device is improved.

According to a sixth aspect, in any one of the first to fifth aspects, the air control device is supported by the cylinder head cover via a bracket (83). According to this configuration, the air control device can be brought close to the cylinder head cover without interfering with the fuel tank, and a hose connecting the air control device and a reed valve can be shortened.

According to a seventh aspect, in any one of the first to sixth aspects, a reed valve (73) is installed on the cylinder head cover, and the air control device is installed behind the reed valve. According to this configuration, the hose is disposed in the air control device from above the cylinder head cover to the lateral side of the cylinder head cover. The hose connecting the reed valve and the air control device can be shortened by an arrangement route avoiding the fuel tank.

Although the present embodiment has been described, other embodiments may be used in which the above-described embodiment and modifications are combined entirely or partially.

The technique according to the present invention is not limited to the above-described embodiment, and may be variously changed, replaced, or modified without departing from the gist of the technical concept. Further, the present disclosure may be implemented by other methods as long as the technical concept can be implemented by the methods through advance of the technique or other derivative techniques. Therefore, the claims cover all embodiments that may fall within the scope of the technical concept.

The invention claimed is:

1. An installation structure for an air control device, the air control device being configured to control supply of secondary air from an air cleaner to an exhaust passage of an engine, the installation structure comprising:

a cylinder head is located above the engine, a cylinder head cover is installed on the cylinder head, a fuel tank is installed above the cylinder head cover, and the air control device is installed on a lateral side of the cylinder head cover below the fuel tank;

wherein a pair of left and right main frames extends from a head pipe toward a vehicle rear side the fuel tank straddles the pair of left and right main frames, the fuel tank is formed with outer side portions covering the pair of left and right main frames from lateral sides, and the air control device is installed between the cylinder head cover and the outer side portion of the fuel tank, and a part of the air control device overlaps with the outer side portion of the fuel tank in a side view.

2. The installation structure for an air control device according to claim 1, wherein a part of a fuel pump protrudes from a bottom surface of the fuel tank above the cylinder head cover, and an upper end of the air control device on the lateral side of the cylinder head cover is positioned more upward than a lower end of the fuel pump above the cylinder head cover.

3. The installation structure for an air control device according to claim 1, wherein the pair of left and right main frames extend from the head pipe toward the vehicle rear side, and the air control device is installed below one of the pair of left and right main frames.

4. The installation structure for an air control device according to claim 1, wherein the air control device is located above a mating surface of the cylinder head and the cylinder head cover.

5. The installation structure for an air control device according to claim 1, wherein the air control device is supported by the cylinder head cover via a bracket.

6. The installation structure for an air control device according to claim 1, wherein a reed valve is installed on the cylinder head cover, and the air control device is installed behind the reed valve.

* * * * *